United States Patent [19]

Rosenkrans

[11] Patent Number: 4,998,047

[45] Date of Patent: Mar. 5, 1991

[54] IGNITION CIRCUIT FOR EXPLOSIVE DEVICES AND THE LIKE

[75] Inventor: Richard A. Rosenkrans, Hesperia, Calif.

[73] Assignee: James E. Meagher, La Canada, Calif.

[21] Appl. No.: 375,204

[22] Filed: Jul. 3, 1989

[51] Int. Cl.[5] ..... H05B 41/36

[52] U.S. Cl. ..... 315/209 R; 315/209 T; 315/219; 315/DIG. 7

[58] Field of Search ..... 315/209 T, 209 R, 209 CD, 315/219, DIG. 7; 307/273

[56] References Cited

U.S. PATENT DOCUMENTS

| | | | |
|---|---|---|---|
| 3,671,805 | 6/1972 | Schuette | 315/209 R |
| 3,731,144 | 5/1973 | McKeown | 315/209 R |
| 3,882,357 | 5/1975 | Nieuweboer | 315/219 |
| 4,033,305 | 7/1977 | Maioglio | 315/209 R |
| 4,077,379 | 3/1978 | Jundt | 315/209 T |
| 4,153,032 | 5/1979 | Château | 315/209 T |
| 4,230,971 | 10/1980 | Gerhard | 315/209 R |
| 4,246,515 | 1/1981 | Schauffele | 315/209 R |
| 4,355,263 | 10/1982 | Buhrlen | 315/209 T |
| 4,833,369 | 5/1989 | White | 315/209 T |

*Primary Examiner*—Eugene R. LaRoche
*Assistant Examiner*—Amir Zarabian
*Attorney, Agent, or Firm*—Harris, Kern, Wallen & Tinsley

[57] ABSTRACT

An ignition circuit for explosives with a monostable multi-vibrator controlling a transistor in circuit with a battery and the primary winding of a switching transformer, with the secondary winding directly connected to spaced electrodes at the explosive.

6 Claims, 1 Drawing Sheet

IGNITION CIRCUIT FOR EXPLOSIVE DEVICES AND THE LIKE

BACKGROUND OF THE INVENTION

This invention relates to electrical circuits for generating sparks for firing explosives and the like and, in particular, to a new and improved monostable multivibrator circuit for generating an electric spark between spaced electrodes for igniting a solid explosive, such as would be used in a firearm for propelling a projectile.

Battery powered oscillator circuits have been used in the past for producing electric arcs between electrodes. See U.S. Pat. Nos. 3,671,805; 3,731,144; and 4,141,297. An improved circuit is shown in U.S. Pat. No. 4,355,263. However during operation and testing of the circuit of the later patent, some disadvantages have been noted. While the circuit does operate, it has been difficult to obtain the desired high output voltage. Also problems were encountered with component burn out, and the operation was sometimes erratic.

Accordingly, it is an object of the present invention to provide a new and improved ignition circuit. It is a particular object to provide such a circuit which has reduced $I^2R$ losses and one which will provide output voltages in the order of 12 kilovolts at an electrode spacing of 0.06 inches.

Another object of the invention *it* to provide such a circuit utilizing a conventional integrated circuit chip and a conventional switching transformer. In particular, it is an object of the invention to provide such an ignition circuit utilizing a monostable multi-vibrator rather than a free running multi-vibrator, and a circuit which provides for setting of pulse width as desired for the particular material to be ignited.

Other objects, advantages, features and results will more fully appear in the course of the following description.

SUMMARY OF THE INVENTION

The ignition circuit is switch operated and provides an electric spark between spaced electrodes for igniting an explosive, with each switch actuation. A switching transformer has its secondary winding directly connected to the spaced electrodes and its primary winding connected in series with a battery and transistor emitter and collector electrode connections. An integrated circuit multi-vibrator has an input connected to the battery through the ignition switch, and an output connected to the transistor circuit. The battery is connected through the ignition switch to the reset and Vcc terminals of the integrated circuit. The threshold and trigger inputs of the integrated circuit are connected to circuit ground through a first capacitor, and the two inputs of the integrated circuit are interconnected by a variable resistor which provides for setting the pulse width of the monostable output. The reset and Vcc input is also connected to circuit ground through a second capacitor and parallel resistor. With this arrangement, the control switch is positioned outside the primary winding of the switching transformer and the integrated circuit is operated as a one shot or monostable multi-vibrator.

DESCRIPTION OF THE PREFERRED EMBODIMENT

Figure 1:
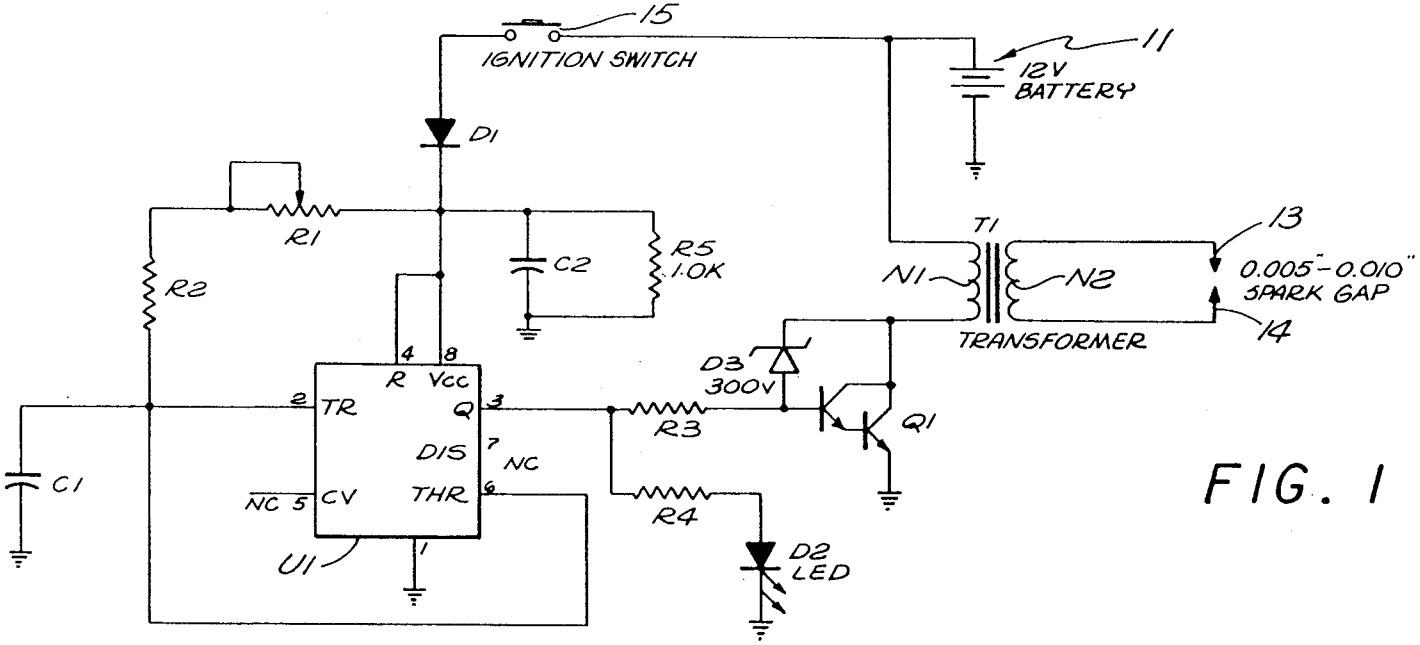
FIG. 1 is an electric circuit diagram of an ignition circuit incorporating the presently preferred embodiment of the invention.

The ignition circuit of FIG. 1 includes a battery 11, a switching transformer T1, and a transistor circuit Q1. The transformer T1 has a primary winding Nl and a secondary winding N2, with the battery 11, the primary winding N1, and the collector and emitter electrode connections of the transistor circuit Q1 connected in series. Typically the transistor circuit Q1 comprises a Darlington transistor. The secondary winding N2 is connected across spaced electrodes 13, 14, which typically are spaced in a range of 0.005 to 0.010 inches (?). The battery 11 typically is a 12 volt battery rated at 1 ampere hour.

The ignition circuit also includes an integrated circuit U1 which is a conventional multi-vibrator circuit having terminals 1–8. The integrated circuit is shown in greater detail in FIG. 2 and typically may be a Texas Instruments NE 555 or a Motorola C6130P or a J4-1555 timer-oscillator chip.

The multi-vibrator terminals 4 and 8 are connected together and are connected to the battery 11 through a diode D1 and an ignition switch 15. In the circuit of the present invention, terminal 4 is a reset input and terminal 8 is a control voltage input, functioning as a first input. The diode D1 is not an essential element in this circuit, functioning to provide over voltage protection.

Terminals 2 and 6 of the integrated circuit are connected together and serve as a second input, with terminal 2 being the trigger input and terminal 6 being the threshold input. This second input is connected to circuit ground through a capacitor C1. A resistance circuit, preferably comprising a variable resistor R1 and a fixed resistor R2 in series, is connected across the two inputs, that is, across terminals 2 and 4 of the integrated circuit. Another capacitor C2 and another resistor R5 are connected in parallel between the first input and the circuit ground.

The output terminal 3 of the integrated circuit is connected to the base of the transistor circuit through resistor R3. A diode D3 is connected across this base and collectors of the transistor circuit, to provide over voltage protection. Another resistor R4 and a light emitting diode D2 are connected in series between the integrated circuit output 3 and circuit ground, to provide a visual indication of operation of the circuit. The resistor R4 and the diodes D2, D3 are not essential but are desirable.

Figure 2:
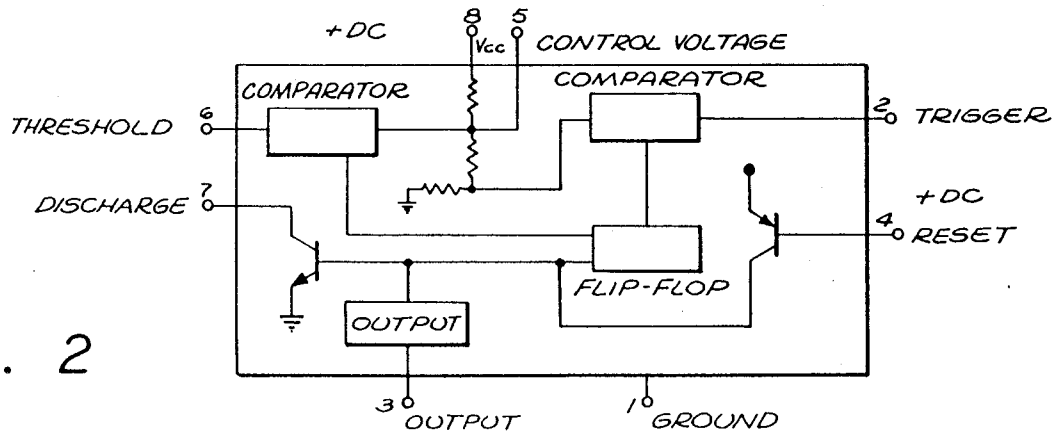
FIG. 2 is a diagram of the integrated circuit chip of FIG. 1.

In operation, switch 15 is closed, connecting the battery to the multi-vibrator circuit. The capacitor C1 is charged through the resistors R1, R2. Terminals 2 and 6 of the integrated circuit are inputs to comparators, as seen in FIG. 2. The comparators are set at 0.33 Vcc and 0.66 Vcc, respectively. During the time period that the voltage across the capacitor C1 is less than 0.33 Vcc, the flip flop of the integrated circuit is set, causing the output at terminal 3 to go to approximately Vcc. This supplies current through the current limiting resistor R3 and drives the transistor circuit Q1 into saturation. The transistor circuit Q1 provides a return path for the battery through the primary winding N1, building a magnetic field in the transformer core.

When the voltage across capacitor Cl increases to 0.66 Vcc, the flip flop of the integrated circuit is reset, turning transistor Q1 off. When this occurs, the magnetic field in the transformer collapses rapidly as compared to its build up time, and this field collapse creates a high potential across the secondary winding N2. This high potential at the electrodes 13, 14 produces the desired spark.

The capacitor C2 and the resistor R5 serve to insure that battery power is supplied to the integrated circuit for a period of time long enough to complete the multi-vibrator cycle even if the ignition switch is closed for less than the total cycle time.

In the operation of the circuit of FIG. 1 a spark at the electrodes 13, 14 is obtained at each closure of the ignition switch 15. The multi-vibrator circuit is operated as a monostable circuit, with one cycle per ignition switch closure. The transformer T1 is a switching transformer in which the magnetic field in the core is built up relatively slowly, while being discharged relatively quickly to produce the desired high voltage at the secondary winding.

The use of a switching transformer with one pulse per spark permits a substantial reduction in size of the overall circuit. Excluding the power source, typical circuit based on the prior art design requires a volume of about 12 cubic inches, while a corresponding circuit of the new design requires a volume of about 4–6 cubic inches.

By way of example, a circuit constructed as shown in FIG. 1 has a charge time of about 50 milliseconds and provides an output voltage of about 12 kilovolts at 0.06 inch spacing between the electrodes. The peak power input is about 40 milliamperes average and the energy is about 0.19 joules, with a cycle time of about 100 milliseconds. The switching transformer discharges in about 400 microseconds to about 50 percent of the power level achieved during the charging portion of ignition cycle.

I claim:

1. In an ignition circuit for an explosive or the like for producing an electric spark between spaced electrodes, the combination of:

a switching transformer having a primary winding and a secondary winding;

means for directly connecting said secondary winding to said spaced electrodes;

transistor means having a base and emitter and collector electrode connections;

a battery having positive and negative terminals;

an on-off switch;

circuit means connecting said transistor electrode connections and said primary winding in a series loop with said battery and separate from said on-off switch;

an integrated circuit multi-vibrator having a first input with a control voltage input and a reset input, a second input with a trigger input and a threshold input, a circuit ground, and an output, with said on-off switch connecting said first input to one terminal of said battery outside said series loop and with said circuit ground connected to the other terminal of said battery a first capacitor connected between said other terminal of said battery and said second input;

a first resistor means connected between said first and second inputs; and a second resistor connected between said output and said transistor base;

with said integrated circuit multi-vibrator operating as a monostable multi-vibrator at one cycle per closure of said switch.

2. An ignition circuit as defined in claim 1 including a third resistor and a second capacitor connected in parallel between said other terminal of said battery and said first input.

3. An ignition circuit as defined in claim 2 including a first diode connected between said switch and said first input for circuit protection.

4. An ignition circuit as defined in claim 3 including a second diode connected between said transistor base and said primary winding for circuit protection.

5. An ignition circuit as defined in claim 4 including a third diode connected in series with a fourth resistor to said integrated circuit output to provide an indication of circuit operation.

6. An ignition circuit as defined in claim 1 wherein said first resistor means includes a variable resistor for adjusting the pulse width of the monostable multi-vibrator output pulse.

* * * * *